United States Patent [19]

Winderman et al.

[11] 4,240,596

[45] Dec. 23, 1980

[54] ARTICULATED EYEBALL RADOME

[75] Inventors: Jay B. Winderman, Claremont; Hans-Peter Schmid, Rancho Cucamonga, both of Calif.

[73] Assignee: General Dynamics Corporation, Pomona Division, Pomona, Calif.

[21] Appl. No.: 929,044

[22] Filed: Jul. 28, 1978

[51] Int. Cl.[3] ..... F42B 15/00

[52] U.S. Cl. ..... 244/3.16; 244/3.19

[58] Field of Search ..... 244/3.19, 3.16, 3.15; 343/6 ND, 757, 872

[56] References Cited

U.S. PATENT DOCUMENTS

| | | | |
|---|---|---|---|
| 2,972,743 | 2/1961 | Svensson et al. | 343/6 ND |
| 3,069,112 | 12/1962 | Patterson | 244/3.19 |
| 3,078,455 | 2/1963 | Brainin | 244/3.19 |
| 3,084,340 | 4/1963 | Stout et al. | 244/3.19 |
| 3,114,149 | 12/1963 | Jessen, Jr. | 343/6 ND |
| 3,995,933 | 12/1976 | Crowhurst | 244/3.16 |

*Primary Examiner*—Charles T. Jordan

*Attorney, Agent, or Firm*—Neil F. Martin; Freling E. Baker; Edward B. Johnson

[57] ABSTRACT

An articulated radome for the front end of a missile or the like comprises a generally dome or spherical shaped articulated housing mounted for rotation about two separate transverse axes, with an infra-red window surrounded by a dielectric window so that both infra-red and radar sending and sensing units may be mounted within the dome for target scanning and the like.

12 Claims, 3 Drawing Figures

ARTICULATED EYEBALL RADOME

BACKGROUND OF THE INVENTION

This invention relates to movable radome and more particularly to a movable radome adaptable to the mounting of multiple sending and/or sensing units for guided missiles.

Prior art guided missiles typically utilize both radar and infra-red sensing units for tracking targets and the like. These units are typically mounted in the nose of the missile and preferably are mounted to have the capability of scanning. However, the prior art approach to such units is complicated and expensive. This is the result of attempts to construct the multi-unit system so that one unit does not interfere with the other.

Ideally, both a radar and infra-red sensing unit must have as wide an angle of view as possible. The systems, however, are somewhat incompatible and typically interfere with one another such that complicated and expensive structures are utilized in an effort to overcome this interference.

The prior art approach to the use of combined radar and infra-red scanning or detecting devices is shown, for example, in the Jessen patent, U.S. Pat. No. 3,114,149, issued Dec. 10, 1963. This patent is directed to a combined radar and infra-red conical scanning antenna, wherein a concavoconvex lens is rotatable about an axis passing through the center of the reflector. Different radii of curvature are provided on the different reflectors and they are so formed that reflection of energy at one frequency occurs from the concave face of the reflector while reflection of energy at a different frequency occurs from the convex face of the reflector.

Another example of this combination is shown, for example, in U.S. Pat. No. 2,972,743, issued Feb. 21, 1961 to Svensson et al. This patent discloses a double reflector wherein a reflecting device for infra-red radiant energy is mounted behind the radar antenna reflector, which is fabricated of open mesh and fastened in front of the infra-red reflector. The infra-red detector is positioned such that the energy is reflected off of two reflectors to the detector. A radar generating device is centrally located with respect to the antennas. With this arrangement, the two systems interfere with one another. Moreover, this system is not readily adaptable to use on missiles.

An optical system for missiles is disclosed in U.S. Pat. No. 4,009,848 to Albert et al, issued Mar. 1, 1977. This patent discloses a fixed window 9 in the nose of a missile, with a gimbal mounted scanning optical system mounted within the nose of the missile for scanning through the lens at the nose of the missile.

Another system somewhat similar to the Albert et al system is that disclosed in U.S. Pat. No. 3,729,152, issued Apr. 24, 1973 to Stephenson. This patent discloses an inertially stabilized optical system for missiles, wherein a scanning device is gimbal mounted and views targets through an enlarged lens 12 constituting the nose of the missile.

A movable radome for the nose of a missile is disclosed in U.S. Pat. No. 3,069,112, issued Dec. 18, 1962 to Patterson. This patent is directed to a radome having a nose cone of a generally pointed spherical configuration with a radar antenna horn mounted in the nose of the missile. The mounting of the nose is such that it may oscillate the antenna about the gimbal connection and rotate it about the axis of the missile for scanning purposes.

The above described systems have numerous drawbacks, including specifically the complex and expensive arrangement of antenna and reflectors. Othe drawbacks include the interference between the multiple sensing systems within the missile.

It is desirable that a simple and effective scanning detection system having multiple sensing means be devised for the nose of a radome of a missile or the like.

SUMMARY AND OBJECTS OF THE INVENTION

It is accordingly the primary object of the present invention to overcome the above problems of the prior art.

Another object of the present invention is to provide a simple and inexpensive multiple sensing system for the nose of a missile that provides for wide angle scanning.

A further object of the invention is to provide an articulated radome for the nose of a missile which is adapted to mount multiple sensing systems with minimal interference and yet have wide angles of detection.

In accordance with the primary aspect of the present invention, an articulated radome for the forward end of a missile comprises a gimbal mounted spherical housing having multiple windows permitting the fixed mounting of a radar antenna and optical sensing device within the dome for wide angle scanning by the swiveling of the radome structure.

BRIEF DESCRIPTION OF THE DRAWING

The above and other objects and advantages of the present invention will become apparent from the following description when read in conjunction with the drawings, wherein.

DETAILED DESCRIPTION OF A PRFERRED EMBODIMENT

Figure 1:
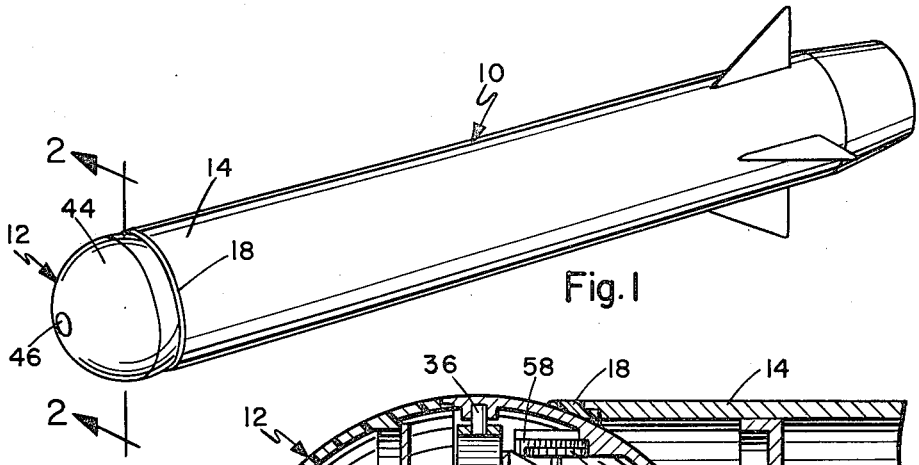
FIG. 1 is a perspective view of a missile incorporating a preferred embodiment of the invention.
Figure 2:
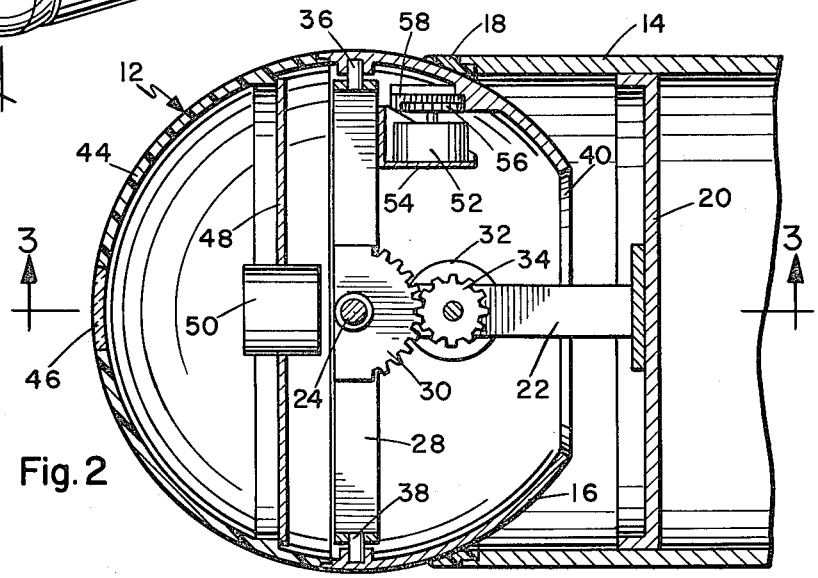
FIG. 2 is an enlarged sectional view of a portion of the missile taken generally on lines 2—2.
Figure 3:
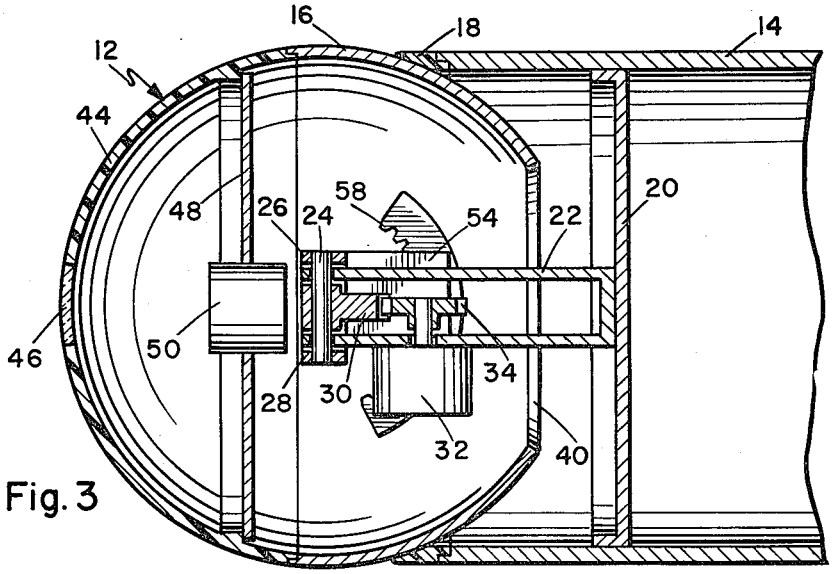
FIG. 3 is a view taken generally on line 3—3 of FIG. 2.

Turning to FIG. 1 of the drawing, a missile 10 includes a radome in accordance with the invention designated generally by the numeral 12. The missile includes a cylindrical body 14 as shown in FIG. 2, having an opening in the forward end thereof in which the generally spherical shaped radome 12 is mounted. The radome can be mounted in the forward end of other air frames other than missiles. The radome comprises a generally spherical dome structure 16 having a diameter slightly greater than that of the tubular housing 14 or body of the missile, and sealingly mounted in the forward open end thereof by means of a seal 18. The greater diameter of the spherical housing reduces or eliminates air turbulence behind it. The seal 18 is preferably of a low friction material such as Teflon.

The spherical housing structure is mounted within the housing 14 and supported by means of mounting assembly including a base or bulkhead member 20, with a forwardly extending bifurcated post or bracket member 22 which pivotally supports the spherical housing by means of a pivot pin 24 extending through bores in the outer end of bracket 22, and through a bore in a frame consisting of side rails 26 and 28. A sector gear 30 pinned or keyed to shaft 24, which in turn is keyed to the side rails 26 and 28, and is driven by means of a servo motor 32 and pinion gear 34. The motor 32 operates to pivot the radome spherical housing in either direction about the pivot axis of pin 24. The dome structure 16 is then pivotally mounted at each end of the frame 26, 28 by means of pivot pins 36, 38 for pivotal movement about an axis perpendicular to the axis of shaft 24. This permits the dome structure to pivot about two transverse axes which are orthogonal to the longitudinal axis of the airframe 10.

Thus, with this arrangement, the radome is mounted for pivotal movement about a pair of transverse axes extending substantially at 90° to one another and at 90° to the longitudinal axis of the missile to permit a wide angle of scanning ahead of the missile. The dome structure 16 includes an opening 40 through which the mounting bracket 22 extends, and includes first and second windows 44 and 46 in the forward end thereof. The window 44 is substantially hemispherical in configuration and is of a dielectric material to permit radar waves such as millimeter waves to pass therethrough. A radar antenna 48 is appropriately mounted within the dome structure to radiate waves through the window portion 44 and to receive reflected waves therethrough.

Mounted centrally on the radar antenna 48 is an infra-red sensor unit 50 in coaxial alignment with the window 46, which is also appropriately an infra-red lens. Thus, with this arrangement, the lens 46 is fixed with respect to the infra-red sensor 50 and thus a small area lens is functionally suitable. With the radome structure as illustrated, it has the capability of a wide angle scanning with both the radar and infra-red sensing devices with a narrow angle inexpensive lens arrangement. With this arrangement, also, minimum interference between the infra-red sensing means and the radar antenna 48 will occur.

Pivoting of the eyeball dome structure about the axis of pivot pins 36 and 38 is achieved by means of a drive motor 52 secured to bracket 54 mounted on frame 26, 28. A drive pinion 56 is mounted on the shaft of the motor 52 and drivingly engages a sector gear or rack 58 fixed on dome structure 16.

The motors 32 and 52 are reversible and connected into a suitable scan control system (not shown). The control system may have any suitable form and number of scan patterns, controlled for example by a pre-programmed computer.

While the invention is discussed in terms of radar and infra-red sensing devices, it will be appreciated that other types of energy radiating and receiving devices may be utilized in the radome. With this arrangement, minimum interference is achieved in the multiple energy transmitting and receiving units and minimum interference is provided with the windows to the structure.

This configuration resembles an eyeball both in structure and in its scanning function and capability. Thus, from the above description it will be apparent that we have provided a simple and improved radome structure for housing multiple scanning devices that permit the widest possible angle of scanning with minimum interference between the scanning devices.

While our invention has been described and illustrated by means of specific embodiments, it is to be understood that numerous changes and modifications may be made therein without departing from the spirit and scope of the invention as defined in the appended claims.

Having described our invention, we now claim:

1. An articulated randome for the forward end of an airframe, said radome comprising:

an articulated spherical nose member adapted to be mounted in the forward end and define the nose of an airframe body, mounting means for mounting said nose member for pivotal movement about first and second transverse axes, first and second means for pivoting the nose member about said first and second transverse axes, energy transmitting window means including an optical lens, in the forward portion of said nose member, and energy sensing means mounted in said nose member for receiving energy through said window means.

2. The radome of claim 1, wherein:

said spherical nose member is mounted in the forward open end of a cylindrical missile body, said mounting means includes a bulkhead member extending transverse to the axis of said cylindrical missile body, a support post secured to and extending forwardly of said bulkhead member, a frame member pivotally mounted on the outer end of said post member about a first pivotal axis and pivot pin means pivotally mounting said spherical nose member on said frame member.

3. The radome structure of claim 2, wherein:

said first and second means comprises first and second servo motors.

4. The radome structure of claim 3, wherein:

a first servo motor is mounted on said post and is drivingly connected by gear means to said frame member, and said second servo motor is mounted on said frame member and is drivingly connected by gear means to said spherical nose member.

5. An articulated radome for the forward end of an airframe, said radome comprising:

an articulated spherical nose member adapted to be mounted in the forward end and define the nose of an airframe body, the diameter of the spherical nose member is greater than that of the airframe body, mounting means for mounting said nose member for pivotal movement about first and second transverse axes, first and second means for pivoting the nose member about said first and second transverse axes, energy transmitting window means in the forward portion of said nose member, and energy sensing means mounted in said nose member for receiving energy through said window means.

6. The radome of claim 4, wherein said window means is a sheet of dielectric material and said sensing means is a radar antenna.

7. The radome of claim 5, wherein:

said spherical nose member is mounted in the forward open end of a cylindrical airframe body, said mounting means includes a bulkhead member extending transverse to the axis of said cylindrical airframe body, a support post secured to and extending forwardly of said bulkhead member, a frame member pivotally mounted on the outer end of said post member about a first pivotal axis and pivot pin means pivotally mounting said spherical nose member on said frame member.

8. The radome structure of claim 7, wherein:

said first and second means comprises first and second servo motors.

9. The radome structure of claim 8, wherein:

said first servo motor is mounted on said post and is drivingly connected by gear means to said frame member, and said second servo motor is mounted on said frame member and is drivingly connected by gear means to said spherical nose member.

10. An articulated radome for the forward end of an airframe, said radome comprising:

an articulated spherical nose member adapted to be mounted in the forward end and define the nose of an airframe body, mounting means for mounting said nose member for pivotal movement about first and second transverse axes, first and second means for pivoting the nose member about said first and second transverse axes, energy transmitting window means including an optical lens in the center thereof in the forward portion of said nose member, energy sensing means mounted in said nose member for receiving energy through said window means, and said energy sensing means includes a radar antenna, and a infra-red sensing device.

11. An articulated radome for the forward end of an airframe, said radome comprising:

an articulated spherical nose member mounted in the forward open end of a cylindrical airframe body and defining the nose of an airframe body, mounting means for mounting said nose member for pivotal movement about first and second transverse axes including a bulkhead member extending transverse to the axis of said cylindrical airframe body, a support post secured to and extending forwardly of said bulkhead member, a frame member pivotally mounted on the outer end of said post member about a first pivotal axis and pivot pin means pivotally mounting said spherical nose member on said frame member for pivoting about a second axis, a first servo motor mounted on said post and drivingly connected by gear means to said frame member, a second servo motor mounted on said frame member and drivingly connected by gear means to said spherical nose member, energy transmitting window means in the forward portion of said window means comprising a semi-spherical member of dielectric material, a substantially circular optical lens mounted in the center of said semi-spherical member, and energy sensing means mounted in said nose member for receiving energy through said window means.

12. The radome of claim 11, wherein said spherical nose member has a diameter greater than that of said cylindrical air frame body.

* * * * *